United States Patent [19]

Nishida

[11] Patent Number: 4,625,669

[45] Date of Patent: Dec. 2, 1986

[54] SMALL-SIZED MARINE CRAFT HAVING AN UPSTANDING PERIPHERAL FLANGE

[75] Inventor: Hiroshi Nishida, Miki, Japan

[73] Assignee: Kawasaki Jukogyo Kabushiki Kaisha, Kobe, Japan

[21] Appl. No.: 750,089

[22] Filed: Jun. 28, 1985

[30] Foreign Application Priority Data

Jul. 2, 1984 [JP] Japan ..... 59-136934

[51] Int. Cl.[4] ..... B63H 11/02

[52] U.S. Cl. ..... 114/56; 114/270

[58] Field of Search ..... 114/270, 357, 56, 38, 114/361, 364, 343; 441/65; D12/300, 306, 310, 312, 313, 314

[56] References Cited

U.S. PATENT DOCUMENTS

| | | | |
|---|---|---|---|
| 3,213,822 | 10/1965 | Sawchuk | 114/270 |
| 3,426,724 | 2/1969 | Jacobson | 114/270 |
| 3,826,220 | 7/1974 | Jacobson | 114/270 |
| 3,948,206 | 4/1976 | Tyler | 114/270 |
| 4,194,460 | 3/1980 | Sato et al. | 440/88 |
| 4,357,893 | 11/1982 | Frye | 114/270 |

*Primary Examiner*—Trygve M. Blix
*Assistant Examiner*—Edwin L. Swinehart
*Attorney, Agent, or Firm*—Leydig, Voit & Mayer, Ltd.

[57] ABSTRACT

A small-sized marine craft having a shell including a deck, an engine mounted in a bow portion of the shell, a propulsion device provided on a stern portion of the shell and a steering handle device provided on a bow portion of the shell. A rear part of the deck is protruded at its breadthwise central portion so as to provide a projecting seat portion and step portions on both sides of the seat portion. Stepped flanges are provided on the outer extremities of the step portions. The stepped flange has an upright wall portion protruding substantially upright from the outer extremity of the step portion and a horizontal wall portion extending laterally outwardly from the upper extremity of the upright wall portion.

5 Claims, 4 Drawing Figures

SMALL-SIZED MARINE CRAFT HAVING AN UPSTANDING PERIPHERAL FLANGE

BACKGROUND OF THE INVENTION

1. Field of the Invention

The present invention relates to a small-sized marine craft for use in marine sports or for leisure purposes, which is suited to running about the sea area near the shore under the control of a rider on the stern portion of the shell who grips a steering handle bar standing up from the bow portion of the shell. More particularly, the invention is concerned with the shape of the shell of such marine craft of the type mentioned above.

2. Description of the Related Art

In general, a small-sized marine craft of the kind described has an engine mounted in an engine room formed in the bow portion of the shell and a propulsion means provided at the stern portion of the same. The rider stands up or sits on a deck portion formed on the shell to the rear of the engine room and grips the steering handle bar on the bow portion of the shell.

The shell has a breadth which is substantially equal to or slightly greater than the shoulder breadth of a rider. The rider and, if any, a fellow rider are seated on a rear portion of the deck.

This type of marine craft is disclosed, for example, in the specification of the U.S. Pat. No. 3,948,206.

The propulsion means may be a propeller or a pumped water jet. Where a pumped water jet is used, the marine craft can be steered by changing the direction of the jet.

Considering that this type of marine craft has an excellent running performance and is capable of running at a considerably high speed of 50 km/h or so, and also that the rider and the fellow rider are seated on the rear deck, it is necessary to reduce rising up of the water onto the deck and to enable the riders to stably support themselves on the deck.

SUMMARY OF THE INVENTION

Accordingly, an object of the invention is to provide a small-sized marine craft which is improved so as to prevent or suppress the rising up of water onto the deck and to prevent accidental lateral slipping of the rider's foot even during a sharp turning of the marine craft.

The small-sized marine craft in accordance with the invention has a shell with a deck, an engine mounted on a bow portion of the shell, a propulsion means mounted on the stern portion of the shell and drivingly connected to the engine, and a steering handle bar standing up from a bow portion. The deck has a projecting seat portion protruded upwardly from the central portion of a rear part of the deck, step portions formed on both sides of the seat portion, and stepped flange portions formed on the outer extermities of both step portions. Each stepped flange portions has an upright wall portion protruding substantially upright from the outer extremely and a horizontal wall portion projecting laterally outwardly from the top of the vertical wall portion.

DESCRIPTION OF THE PREFERRED EMBODIMENTS

Figure 1:
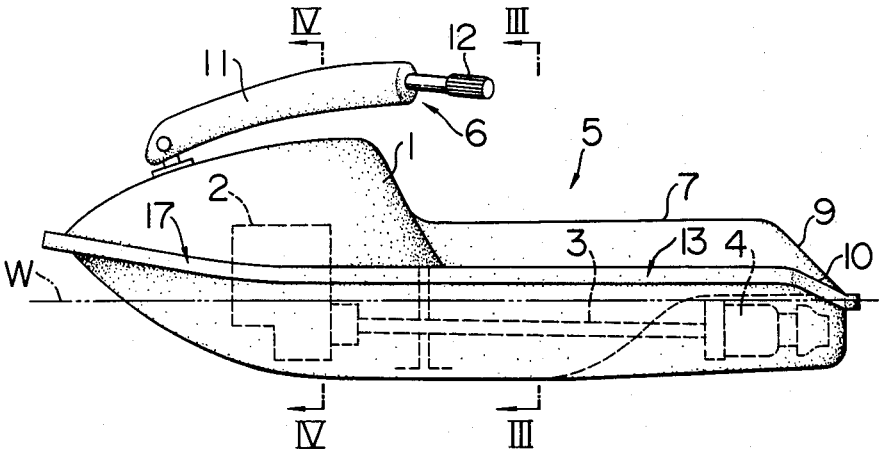
FIG. 1 is a side elevational view of an embodiment of a small-sized marine craft in accordance with the invention.
Figure 2:
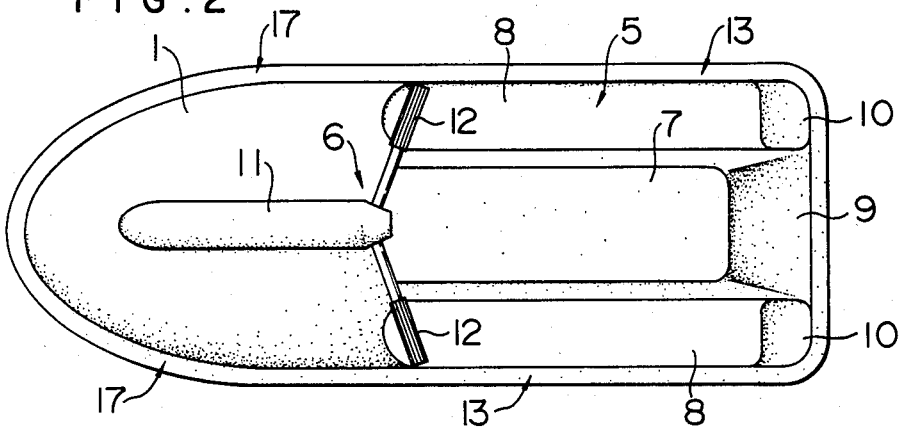
FIG. 2 is a plan view of the small-sized marine craft shown in FIG. 1.

Referring to FIGS. 1 to 4, a small-sized marine craft of the invention has a shell in the front portion of which is formed a hermetic engine room 1 which accomodates an engine 2. A propulsion means 4 provided on the stern portion of the shell is driven by the engine 2 through a driving shaft 3. A rear deck 5 behind the engine room 1 provides a seat for a rider and a fellow rider.

A steering handle device designated by a numeral 6 is provided on a bow portion of the marine craft. The rider controls the marine craft and supports himself by means of the steering handle device.

The rear deck 5 has a central protrusion which constitutes a projecting seat portion 7, with step portions 8,8 formed on both sides of the seat portion 7. In the illustrated embodiment, the tail end 9 of the seat portion 7 and the tail ends 10,10 of the step portions 8,8 slope rearwardly and downwardly, so that the rider, when in the water, can easily pull him up to the deck by the force of this arms by such an action as to pull the steering handle device 6.

The steering handle device 6 inclues a vertically rockable boom 11 extending along the upper side of the engine room 1 and handle bars 12,12 attached to the upper end of the boom 11. Alternatively, the steering handle device may be of the type in which a handle bar or a steering wheel 1 is attached to the upper end of a rotatable pillar so as to turn a skid plate thereby steering the marine craft.

Figure 3:
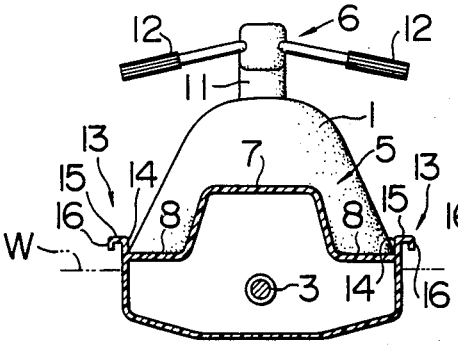
FIG. 3 is a cross-sectional view taken along the line III—III of FIG. 1.

As will be seen from FIG. 3, stepped flange portions 13,13 are formed along the outer extremities of the step portions 8,8. Each stepped flange portion 13 has an upright wall portion 14 of a predetermined height, e.g., 20 mm, and a horizontal wall portion 15 of a predetermined width, e.g., 30 mm. In the illustrated embodiment, the stepped flange portion further has a downward wall portion 16 which extends downwardly from the outer extremity of the horizontal wall portion 15 so that the stepped flange portion 13 as a whole has a substantially inversed U-shaped cross-section, but this downward wall portion 16 is not essential. Although in the illustrated embodiment the stepped flange portion 13 is formed of a web-like material bent in an inversed U-shaped form so as to open downwardly, it is also possible to form the stepped flange portion 13 with a solid material having a substantially rectangular cross-section. In such a case, the upright wall portion 14, horizontal wall portion 15 and the downward wall portion 16 are constituted by three adjacent sides of the rectangular cross-section of solid material.

Figure 4:
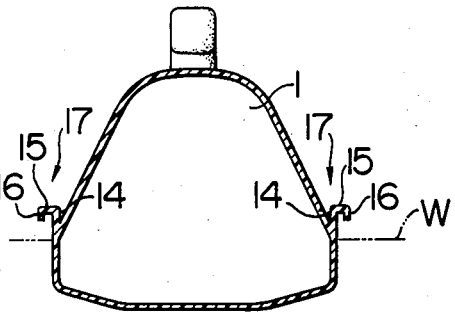
FIG. 4 is a cross-sectional view taken along the line IV—IV of FIG. 1.

As will be seen from FIG. 4, the peripheral portion of the shell other than the step portions 8,8 are provided with a continuous lateral extension 17 corresponding to the stepped flange portion 13. The lateral extension 17 has a horizontal wall portion and a downward wall portion which are continuous from the horizontal wall portion 15 and the downward wall portion 16 of the stepped flange portion 13. Thus, the horizontal wall portion 15 and the downward wall portion 16 are provided substantially over the entire periphery of the shell.

Preferably, the lateral extension 17 is inclined upwardly and forwardly at the bow portion of the shell, as shown in FIG. 1. The upward and forward inclination of the horizontal extension 17 around the bow is effective in that the water punching the bow during the running produces an upward moment so as to prevent any tendency for the bow to submerge, thereby ensuring optimum posture of the marine craft during the running.

As will be understood from the foregoing description taken in conjunction with FIGS. 1 to 4, according to the invention, the marine craft has a projecting seat portion 7 protruding upright from the central portion of the rear deck 5, step portions 8,8 formed on both sides of the seat portion 7, and stepped flange portions 13,13 on the outer extremities of the stepped portions 8,8 each of the stepped flange portions having an upright wall portion 14 and a horizontal wall portion 15. With this arrangement, it is possible to substantially eliminate or suppress the tendency for the water to come up to the rear deck which tends to occur particularly when the marine craft is making a sharp turn. In addition, the rider and the fellow rider, if any, can place their feet inside the upright wall portion 14 so that the risk of accidental slip can be avoided perfectly. Furthermore, a horizontal extension 17 continuous from the stepped flange portion 13 is formed around the shell at the forward side of the stepped portions 8,8. The part of the horizontal extension 17 around the bow is inclined upwardly and forwardly so that the tendency for the water to come up onto the rear deck 5 is further suppressed and, at the same time, the water punching the bow produces an upward or lift component of force so as to suppress any tndency for the bow to submerge, thereby allowing the marine craft to maintain an optimum skidding posture, usually at a forward elevation angle of about 4°.

In addition, accidental lateral slip of the rider's foot is avoided by virtue of th provision of the stepped flange portion 13. Since the rider can be seated on the projecting seat portion 7 so that his legs are positioned on the step portions 8 on both sides of the seat portion 7, the breadth of the shell can be minimized so as to reduce the buoyancy, thereby allowing a higher running performance. In addition, the reduced breadth of the shell permits the rider to easily get on board over a lateral side of the shell when the marine craft starts from a shoal, as in the case of a motorcycle.

What is claimed is:

1. A small-sized marine craft comprising:

a shell including a deck having a projecting seat portion protruding upright from a rear part of said deck, step portions on both sides of said seat portion, and stepped flange portions formed on outer extremities of said step portions, each of said stepped flange portions having an upright wall portion standing substantially upright from said outer extremity of said step portion and a horizontal wall portion extending laterally outwardly from a top of said upright wall portion, said stepped flange portions extending around and meeting at the stern of the craft to provide a continuous stepped flange at the stern;

said seat portion and said step portions having downwardly sloping tail end portions at the stern of the craft meeting said continuous stepped flange;

an engine mounted in a bow portion of said shell;

a propulsion means provided on a stern portion of said shell and drivingly connected to said engine; and a steering handle device provided on a bow portion of said shell.

2. A small-sized marine craft according to claim 1 in which each of said stepped flange portions further has a downward wall portion extending downwardly from an outer extremity of said horizontal wall portion.

3. A small-sized marine craft according to claim 2 in which said shell is provided with a horizontal extension projected substantially horizontally from the periphery thereof and continuing from said stepped flange portions, so that said shell has a horizontal wall portion and a downward wall portion substantially over an entire periphery thereof.

4. A small-sized marine craft according to claim 3, in which said horizontal extension is inclined forwardly and upwardly at the bow portion of said shell.

5. A small-sized marine craft according to claim 4, in which an angle of forward and upward inclination of said horizontal extension is about 4°.

* * * * *